US010954795B2

(12) United States Patent
Silet et al.

(10) Patent No.: US 10,954,795 B2
(45) Date of Patent: Mar. 23, 2021

(54) TURBO ENGINE ROTOR DISC

(71) Applicant: SAFRAN AIRCRAFT ENGINES, Paris (FR)

(72) Inventors: Benoît Guillaume Silet, Moissy Cramayel (FR); Youki Olivier Ito-Lardeau, Moissy Cramayel (FR); Gilles Marcel Jeannin, Moissy Cramayel (FR); Baptiste Marie Aubin Pierre Jouy, Moissy Cramayel (FR); Bertrand Guillaume Robin Pellaton, Moissy Cramayel (FR); Josselin Luc Florent Sicard, Moissy Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/324,010

(22) PCT Filed: Jul. 21, 2017

(86) PCT No.: PCT/FR2017/052011

§ 371 (c)(1),
(2) Date: Feb. 7, 2019

(87) PCT Pub. No.: WO2018/029408

PCT Pub. Date: Feb. 15, 2018

(65) Prior Publication Data

US 2019/0169991 A1 Jun. 6, 2019

(30) Foreign Application Priority Data

Aug. 8, 2016 (FR) ..... 1657634

(51) Int. Cl.

| | |
|---|---|
| ***F01D 5/08*** | (2006.01) |
| ***F01D 25/12*** | (2006.01) |
| ***F01D 5/30*** | (2006.01) |

(52) U.S. Cl.
CPC ..... *F01D 5/081* (2013.01); *F01D 5/3007* (2013.01); *F01D 5/3023* (2013.01); *F01D 25/12* (2013.01);
(Continued)

(58) Field of Classification Search
CPC .... F01D 5/3092; F01D 5/3023; F01D 5/3007; F01D 5/081; F01D 25/12; F01D 11/006;
(Continued)

(56) References Cited

U.S. PATENT DOCUMENTS

| | | | | |
|---|---|---|---|---|
| 2,010,022 A | | 8/1935 | Holzwarth | |
| 4,910,958 A | * | 3/1990 | Kreitmeier | F01D 5/081 415/117 |
| 6,575,704 B1 | * | 6/2003 | Tiemann | F01D 11/006 416/219 R |

FOREIGN PATENT DOCUMENTS

| | | |
|---|---|---|
| EP | 0 313 826 A1 | 5/1989 |
| EP | 2 299 056 A1 | 3/2011 |

(Continued)

OTHER PUBLICATIONS

International Preliminary Report on Patentability and the Written Opinion of the International Searching Authority as issued in International Patent Application No. PCT/FR2017/052011, dated Feb. 12, 2019.

(Continued)

*Primary Examiner* — Kenneth Bomberg
*Assistant Examiner* — Julian B Getachew
(74) *Attorney, Agent, or Firm* — Pillsbury Winthrop Shaw Pittman LLP

(57) ABSTRACT

A turbo engine rotor disc that has a rotation axis and includes, at the periphery thereof, a plurality of slots regularly distributed around the rotation axis, wherein at least one slot of the plurality of slots has a base that has a plurality (Continued)

of plates arranged in staggered rows and protruding from the base, each plate extending mainly along a direction perpendicular to a radial direction.

8 Claims, 5 Drawing Sheets

(52) U.S. Cl.
CPC ..... *F05D 2240/24* (2013.01); *F05D 2260/20* (2013.01); *F05D 2260/22141* (2013.01)

(58) Field of Classification Search
CPC .... F01D 5/08; F05D 2260/20; F05D 2240/24; F05D 2260/22141
See application file for complete search history.

(56) References Cited

FOREIGN PATENT DOCUMENTS

| | | | |
|---|---|---|---|
| EP | 2 672 182 | A2 | 12/2013 |
| WO | WO 2015/038305 | A2 | 3/2015 |

OTHER PUBLICATIONS

International Search Report as issued in International Patent Application No. PCT/FR2017/052011, dated Nov. 9, 2017.

* cited by examiner

TURBO ENGINE ROTOR DISC

CROSS REFERENCE TO RELATED APPLICATIONS

This application is the U.S. National Stage of PCT/FR2017/052011, filed Jul. 21, 2017, which in turn claims priority to French Patent Application No. 1657634 filed Aug. 8, 2016, the entire contents of all applications are incorporated herein by reference in their entireties.

TECHNICAL FIELD OF THE INVENTION

Generally speaking, the present invention relates to the field of turbo engine rotor discs provided at the periphery thereof with slots in which are mounted blade roots. More specifically, the present invention relates to a device for cooling a slot of a turbo engine rotor disc.

TECHNOLOGICAL BACKGROUND OF THE INVENTION

In a manner known per se, a turbo engine rotor disc, such as a disc of a stage of the low pressure (LP) turbine, comprises at the periphery thereof a plurality of slots regularly distributed around the rotation axis of the disc, in which are mounted by socketing together the roots of the moving blades of the turbine.

When the turbo engine is in operation, the flow path of the low pressure turbine in which the blades are arranged is traversed by gases, the temperature of which is very high. Since the slots of the discs that receive the roots of the blades are directly exposed to these gases, it is necessary to cool them to avoid any damage to the discs.

To this end, it is known to withdraw a part of the air that flows outside of the flow path of the low pressure turbine in order to convey it via a cooling circuit to the slots of the rotor discs. FIG. 1 shows a partial view of a rotor disc 1 of a low pressure turbine of a turbo engine according to the prior art. The partial view of FIG. 1 is a section along a plane perpendicular to the rotation axis of the disc. The disc 1 comprises at the periphery thereof a plurality of slots 4, open towards the outside of the disc 1 and regularly distributed around the rotation axis of the disc 1. The disc 1 comprises an annular clamp 2 which extends upstream from the upstream radial face of the disc 1 and around which is mounted an annular maintaining flange (not represented). The annular clamp 2 and the maintaining flange are arranged so as to form between them an annular space forming a diffusion cavity for the cooling air. This diffusion cavity is supplied with cooling air at its upstream end through a plurality of orifices 3 regularly distributed around the rotation axis of the disc 1, and emerges at its downstream end in the base of each of the slots 4 of the disc 1. The air circulating outside of the flow path of the turbine penetrates into the diffusion cavity through the orifices 3, diffuses in the diffusion cavity then ventilates and cools the slots 4.

SUMMARY OF THE INVENTION

The present invention allows to improve the cooling of a turbo engine rotor disc slot, the slot furthermore being connected to a cooling circuit according to the prior art.

A first aspect of the invention relates to a turbo engine rotor disc having a rotation axis and including, at the periphery thereof, a plurality of slots regularly distributed around the rotation axis, at least one slot of the plurality of slots having a base that has a plurality of plates protruding from said base, each plate extending mainly along a direction perpendicular to a radial direction.

"Radial direction" is taken to mean a direction along a radius of the rotor disc. For each plate protruding from a slot base, the projection of said plate on the slot base is considered: in this projection, the plate has a first dimension along a first direction substantially perpendicular to the radial direction and a second dimension along a second direction substantially perpendicular to the radial direction and distinct from the first direction. "The plate extends mainly along a direction perpendicular to the radial direction" is taken to mean the fact that the first dimension is small compared to the second dimension, or that the second dimension is small compared to the first dimension.

Thanks to the invention, the plurality of plates protruding from the base of the slot makes it possible to increase the exchange surface of the base of the slot, thereby contributing to improving thermal transfer between a flux of cooling air and the base of the slot.

A second aspect of the invention relates to an assembly of a turbo engine rotor disc and at least one blade, the turbo engine rotor disc having a rotation axis and including, at the periphery thereof, a plurality of slots regularly distributed around the rotation axis, at least one slot of the plurality of slots having a base that has a plurality of plates arranged in staggered rows and protruding from said base, each plate extending mainly along a direction perpendicular to a radial direction, said at least one blade comprising a root arranged in said at least one slot and resting on the plurality of plates so as to form a space between the root of the blade and the base of said at least one slot.

Apart from the characteristics that have been described in the preceding paragraphs, the turbo engine rotor disc according to the first aspect of the invention or the set of a turbo engine rotor disc and at least one blade according to the second aspect of the invention may have one or more additional characteristics among the following, considered individually or according to all technically possible combinations thereof:

- The plurality of plates preferentially comprises at least three plates arranged in staggered rows.
- At least one plate of the plurality of plates protruding from the base has a first dimension along the radial direction, a second dimension along an axial direction and a third dimension along a circumferential direction. According to a first alternative, the at least one plate extends mainly along the axial direction. "Axial direction" is taken to mean a direction parallel to the rotation axis of the disc.
- For the at least one plate according to the first alternative, the second dimension along the axial direction is preferentially 3 to 60 times greater than the third dimension along the circumferential direction.
- According to a second alternative, at least one plate of the plurality of plates protruding from the base extends mainly along the circumferential direction. "Circumferential direction" is taken to mean a direction both perpendicular to the radial direction and perpendicular to the axial direction. Apart from the increase in the exchange surface of the base of the slot, the at least one plate extending mainly along the circumferential direction advantageously causes a maximum perturbation of the flow of a cooling flux that takes effect substantially axially, from the upstream to the downstream of each slot of the rotor disc. By perturbing the flow of the cooling flux, the at least one plate according to the second alternative increases the turbulence of the cooling flux and thereby improves the exchange coefficient between the cooling flux and the slot. By increasing the amount of thermal flux that is extracted from the disc, the disc is cooled more efficiently.

For the at least one plate according to the second alternative, the third dimension along the circumferential direction is preferentially 2 to 16 times greater than the second dimension along the axial direction.

According to a third alternative, at least one slot of the plurality of slots advantageously has a base that has:

at least one plate protruding from said base and extending mainly along the axial direction, and at least one plate protruding from said base and extending mainly along the circumferential direction.

According to the third alternative, the at least one plate extending mainly along the axial direction is preferentially arranged on a downstream part of the base whereas the at least one plate extending mainly along the circumferential direction is preferentially arranged on an upstream part of the base. The upstream and downstream parts are defined as a function of the direction of circulation of the cooling air along the axial direction. The at least one plate extending mainly along the circumferential direction is advantageously on the upstream part of the base in order that the turbulences created within the flux of cooling air by said at least one plate contribute to favouring thermal exchanges at the level of the at least one plate extending mainly along the axial direction, on the downstream part.

According to any of the first, second and third alternatives, the rotor disc is preferentially a rotor disc of a low pressure turbine.

The invention and its different applications will be better understood on reading the description that follows and by examining the figures that accompany it.

BRIEF DESCRIPTION OF THE FIGURES

The figures are presented for indicative purposes and in no way limit the invention.

DETAILED DESCRIPTION OF AT LEAST ONE EMBODIMENT OF THE INVENTION

Unless stated otherwise, a same element appearing in the different figures has a single reference.

Figure 1:
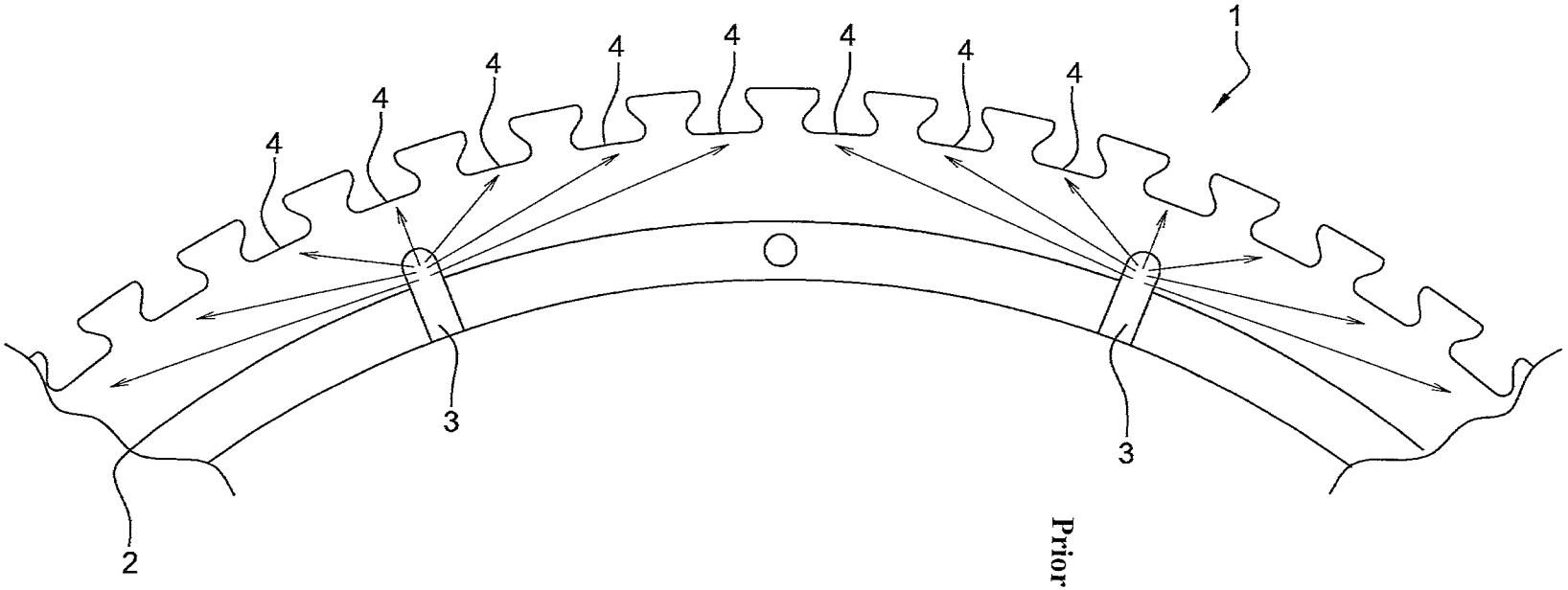
Prior Art Fig. 1
FIG. 1 shows a partial view of a turbo engine low pressure turbine rotor disc according to the prior art.

FIG. 1, which shows a partial view of a turbo engine low pressure turbine rotor disc 1 according to the prior art, has been described previously.

Figure 2:
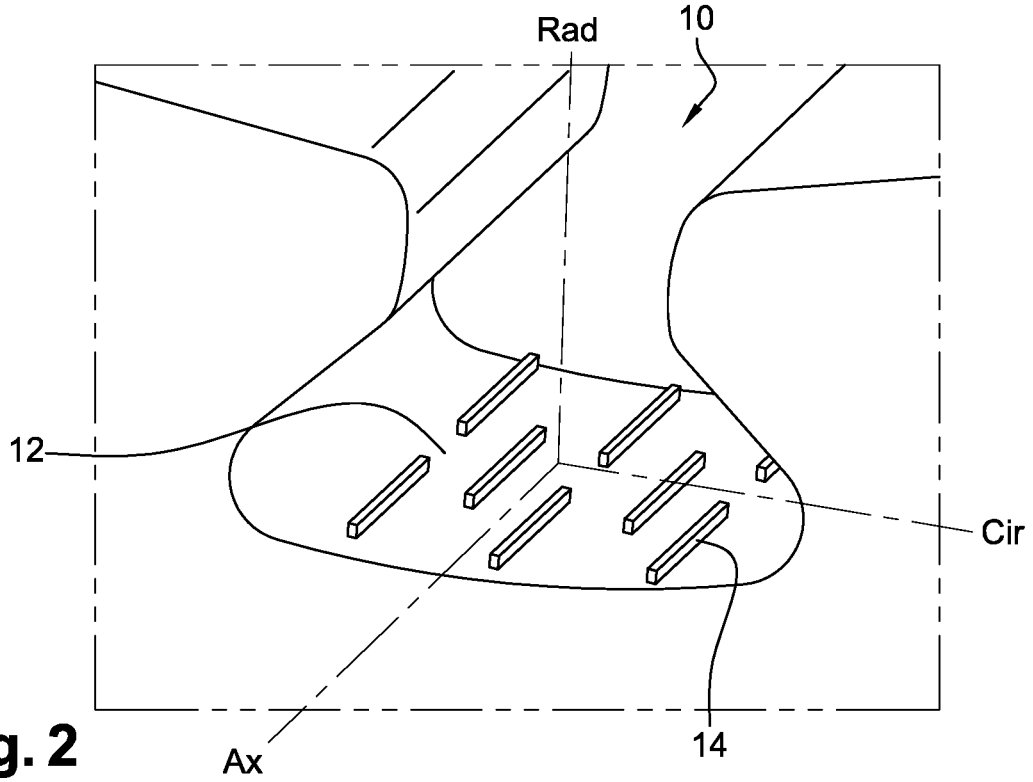
FIG. 2 shows a slot of a turbo engine rotor disc according to a first embodiment of the invention.

FIG. 2 shows a slot 10, having a base 12, of a turbo engine rotor disc according to a first embodiment of the invention. The shape of the slot 10 illustrated in FIG. 2 is chosen to cooperate with a blade root, so as to form a blade-disc connection. The blade root and the slot 10 are dimensioned in such a way as to form, when the blade root is mounted in the slot 10, a space between the base 12 of the slot and the blade root, a space in which cooling air can circulate.

The base 12 of the slot typically has a length L1, measured along an axial direction referenced "Ax", comprised between 1 cm and 3 cm, and a width L2, measured along a circumferential direction referenced "Cir", comprised between 0.5 cm and 1 cm.

According to the first embodiment, the base 12 of the slot 10 comprises a plurality of plates 14 protruding from the base 12. Each plate 14 has:

a first dimension along a radial direction, referenced "Rad", a second dimension along the axial direction Ax, and a third dimension along the circumferential direction.

The radial direction is along a radius of the rotor disc: at each point of the rotor disc, the radial direction passes through said point and through the centre of the rotor disc. The axial direction is parallel to the rotation axis of the rotor disc. At each point of the rotor disc, the axial direction is thus perpendicular to the radial direction. The circumferential direction is defined as being, at each point of the rotor disc, both perpendicular to the radial direction and perpendicular to the axial direction. According to the first embodiment, each plate 14 extends mainly along its second dimension, in the axial direction Ax. The third dimension of each plate 14 is small compared to the second dimension of said plate 14: the second dimension of each plate 14 is preferentially 3 to 60 times greater than the third dimension of each plate 14. According to an alternative of the first embodiment, not illustrated, at least one plate of the plurality of plates extends mainly in the axial direction Ax, whereas at least one other plate of the plurality of plates extends mainly in a direction perpendicular to the radial direction Rad but distinct from the axial direction Ax.

The first dimension of each plate 14 is preferentially chosen such that, when a blade root is arranged in the slot, said first dimension is comprised between 25% and 75% of the minimum backlash between the slot base and the blade root. The second dimension of each plate 14 is preferentially comprised between 30% and 100% of the length of the slot base 12. The third dimension of each plate 14 is preferentially comprised between 0.5 mm and 1 mm.

Figure 3A:
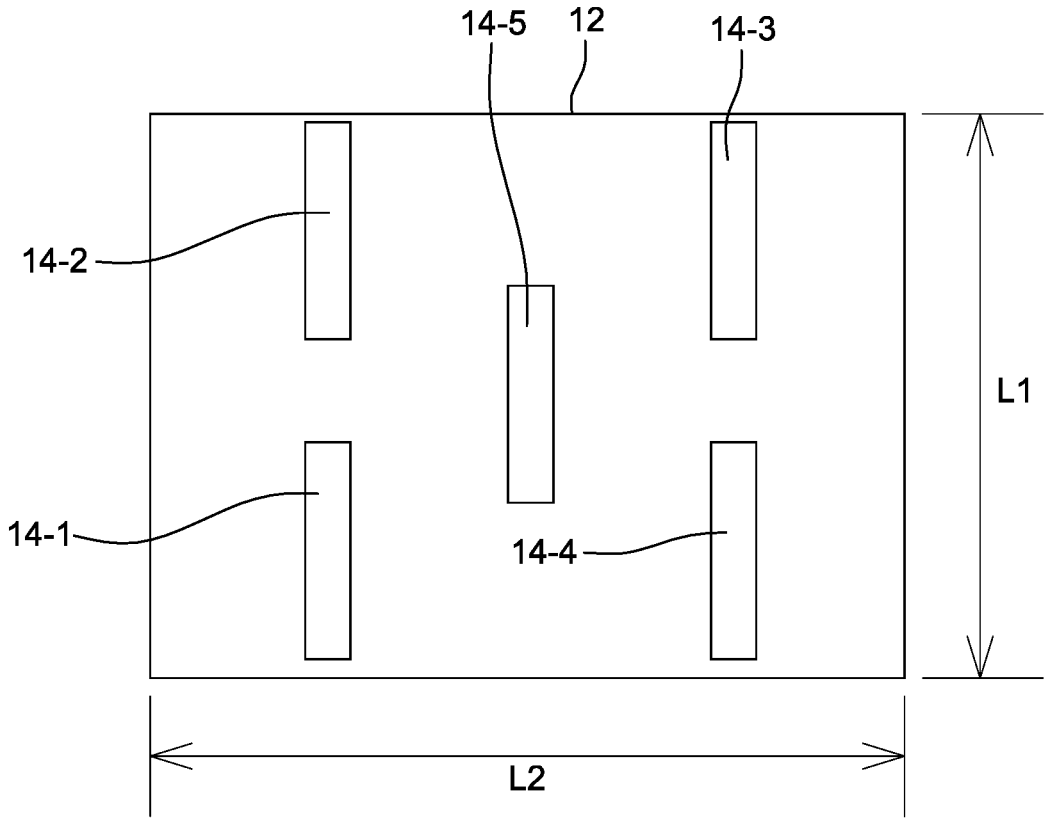
FIG. 3*a* shows a sectional view of the slot of FIG. 2 and illustrates a first exemplary arrangement of plates at the base of a slot, according to the first embodiment of the invention.
Figure 3B:
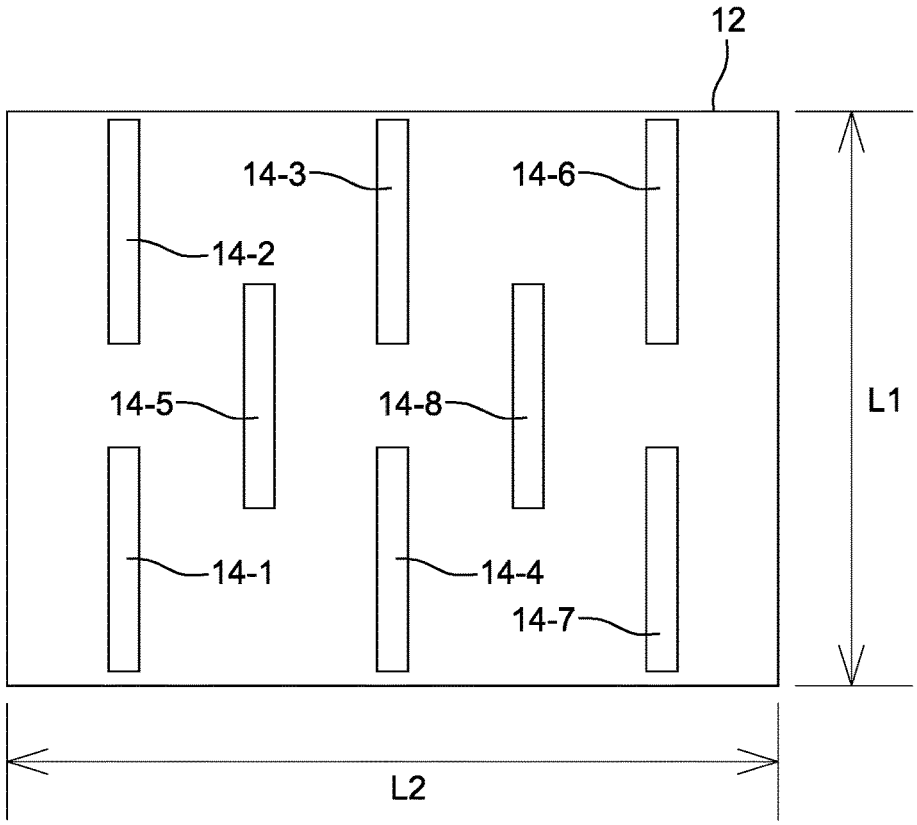
FIG. 3*b* shows a second exemplary arrangement of plates at the base of a slot, according to the first embodiment of the invention.
Figure 3C:
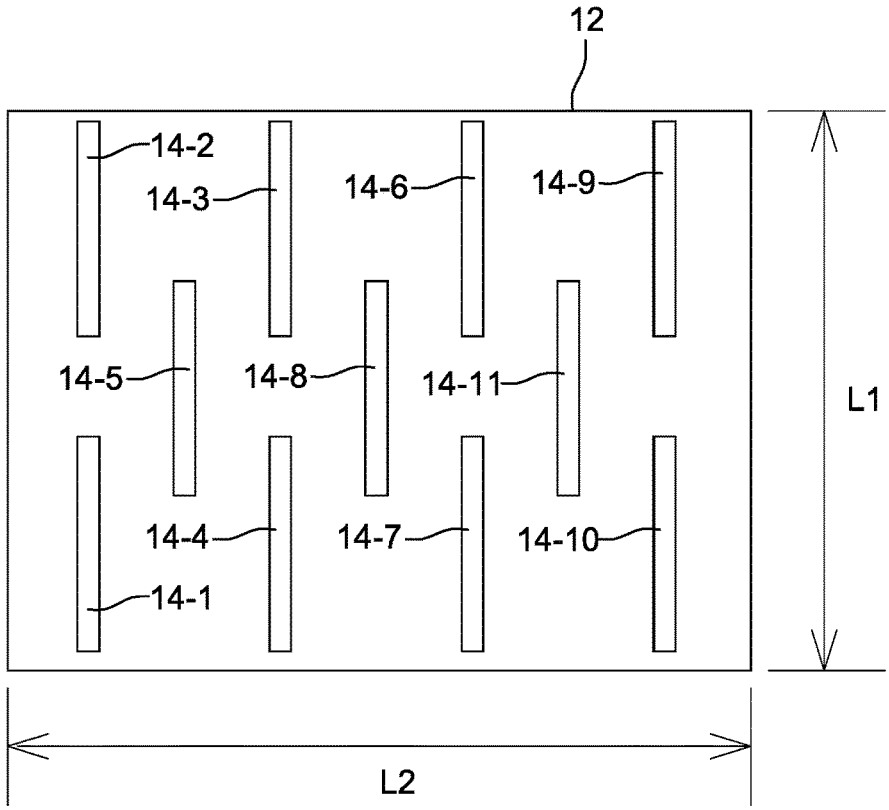
FIG. 3*c* shows a third exemplary arrangement of plates at the base of a slot, according to the first embodiment of the invention.

FIG. 3*a* shows a sectional view, along a plane perpendicular to the radial direction, of the slot 10 of FIG. 2. In this particular example, the base of the slot 10 comprises five plates 14, more specifically the first, second, third, fourth and fifth plates 14-1, 14-2, 14-3, 14-4, 14-5, arranged in staggered rows. An arrangement in staggered rows is taken to mean an arrangement in which, by groups of five plates, four plates are located centred at the four vertices of a rectangle and the fifth is centred at the centre of the rectangle. To be specific, in the particular example of FIG. 3*a*, the first, second, third and fourth plates 14-1, 14-2, 14-3, 14-4 are centred at the four vertices of a rectangle whereas the fifth plate 14-5 is centred at the centre of the rectangle. FIG. 3*b* shows another particular example of slot, the base of which comprises eight plates 14, more specifically the first, second, third, fourth and fifth plates 14-1, 14-2, 14-3, 14-4, 14-5 as well as the sixth, seventh and eighth plates 14-6, 14-7, 14-8, arranged in staggered rows. FIG. 3*c* shows another example of slot, the base of which comprises eleven plates 14, more specifically the first, second, third, fourth, fifth, sixth, seventh and eighth plates 14-1, 14-2, 14-3, 14-4, 14-5, 14-6, 14-7, 14-8 as well as the ninth, tenth and eleventh plates 14-9, 14-10, 14-11, arranged in staggered rows. Each of the three particular examples described in relation with FIGS. 3*a*, 3*b* and 3*c* comprises at least five plates 14 arranged in staggered rows, but generally speaking the base of the slot 10 comprises at least three plates 14 arranged in staggered rows, more specifically the first plate 14-1, the second plate 14-2 and the fifth plate 14-5 or any pattern of three plates 14 thereby arranged; or the first plate 14-1, the fourth plate 14-4 and the fifth plate 14-5 or any pattern of three plates 14 thereby arranged. In each of these examples, the plates 14 are regularly distributed over the slot base. "Regularly distributed" is taken to mean the fact that two plates consecutively aligned along a same direction have between them a spacing, measured along the direction of alignment, which does not vary.

Figure 4:
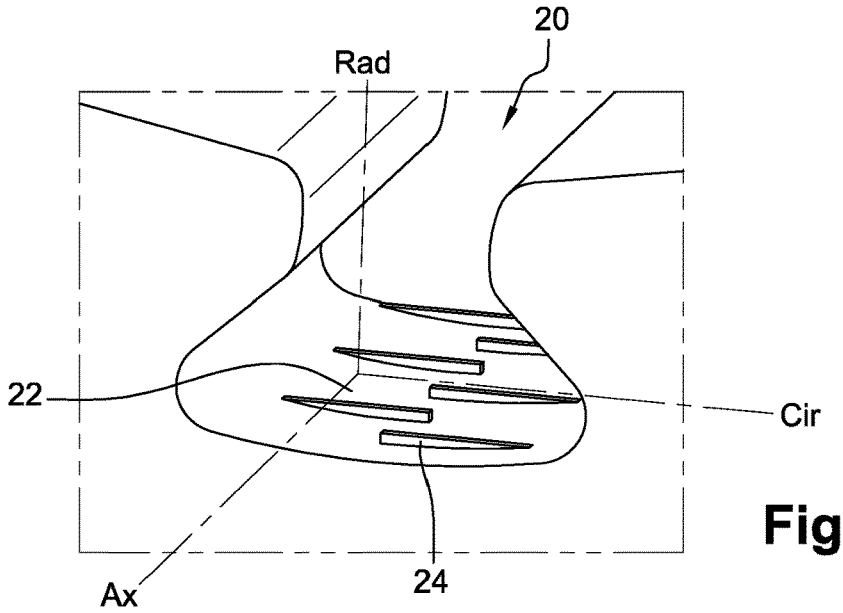
FIG. 4 shows a slot of a turbo engine rotor disc according to a second embodiment of the invention.

FIG. 4 shows a slot 20, having a base 22, of a turbo engine rotor disc according to a second embodiment of the invention. In the same way as for the slot 10 according to the first embodiment, the shape of the slot 20 illustrated in FIG. 4 is chosen to cooperate with a blade root, so as to form a blade-disc connection. The blade root and the slot 20 are dimensioned in such a way as to form, when the blade root is mounted in the slot 20, a space between the base 22 of the slot and the blade root, a space in which cooling air can circulate.

The base 22 of the slot typically has a length L1, measured along the axial direction Ax, comprised between 1 cm and 3 cm, and a width L2, measured along the circumferential direction Cir, comprised between 0.5 cm and 1 cm. According to the second embodiment, the base 22 of the slot 20 comprises a plurality of plates 24 protruding from the base 22. Each plate 24 has:

a first dimension along the radial direction Rad, a second dimension along the axial direction Ax, and a third dimension along the circumferential direction Cir.

According to the second embodiment, each plate 24 extends mainly along its third dimension, in the circumferential direction Cir. The second dimension of each plate 24 is small compared to the third dimension of said plate 24: the third dimension of each plate 24 is preferentially 2 to 16 times greater than the second dimension of each plate 24. According to an alternative of the second embodiment, not illustrated, at least one plate of the plurality of plates extends mainly in the circumferential direction Cir, whereas at least one other plate of the plurality of plates extends mainly in a direction perpendicular to the radial direction Rad but distinct from the circumferential direction Cir.

The first dimension of each plate 24 is preferentially chosen such that, when a blade root is arranged in the slot, said first dimension is comprised between 25% and 75% of the minimum backlash between the slot base and the blade root. Each plate 24 may have a first dimension along the radial direction Rad that is substantially variable, notably to adapt itself to the shape of the base 22, which may not be perfectly flat. In such a case, the first dimension of each plate 24 is defined as being the largest dimension of said plate 24 along the radial direction Rad. The second dimension of each plate 24 is preferentially comprised between 0.5 mm and 2 mm. The third dimension of each plate 24 is preferentially comprised between 20% and 80% of the width of the base 22 of the slot.

Figure 5A:
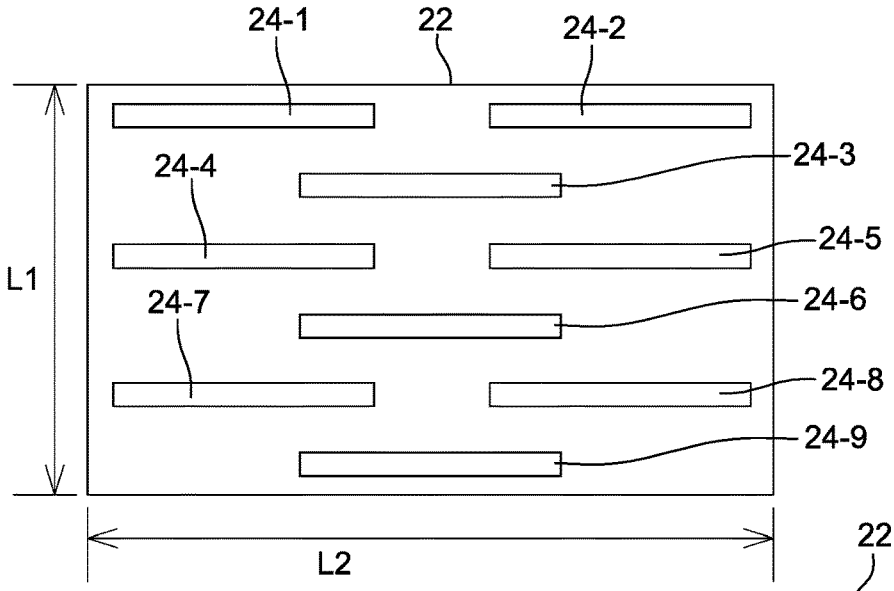
FIG. 5*a* shows a sectional view of the slot of FIG. 4 and illustrates a first exemplary arrangement of plates at the base of a slot, according to the second embodiment of the invention.
Figure 5B:
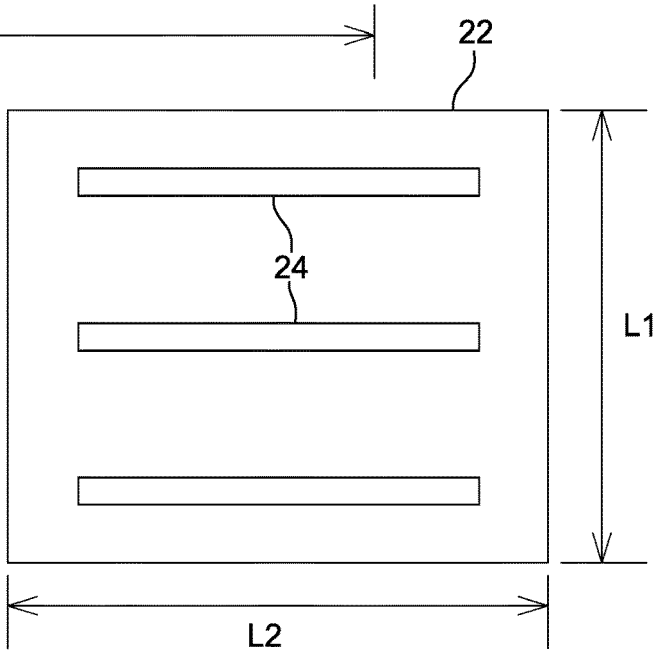
FIG. 5*b* shows a second exemplary arrangement of plates at the base of a slot, according to the second embodiment of the invention.

FIG. 5*a* shows a sectional view, along a plane perpendicular to the radial direction, of the slot 20 of FIG. 4. In this particular example, the base of the slot 10 comprises nine plates 24, more specifically first, second, third, fourth, fifth, sixth, seventh, eighth and ninth plates 24-1, 24-2, 24-3, 24-4, 24-5, 24-6, 24-7, 24-8, 24-9 arranged in staggered rows. Generally speaking, the base of the slot 20 comprises at least three plates 24 arranged in staggered rows, more specifically the first, second and third plates 24-1, 24-2, 24-3 or any pattern of three plates thereby arranged; or the first, third and fourth plates 24-1, 24-3, 24-4 or any pattern of three plates thereby arranged. FIG. 5*b* shows another particular example of slot, the base of which comprises three plates 24 arranged in an aligned manner along the axial direction Ax. In each of these examples, the plates 24 are regularly distributed over the base of the slot. "Regularly distributed" is taken to mean the fact that two plates consecutively aligned along a same direction have between them a spacing, measured along the direction of alignment, which does not vary.

Figure 6:
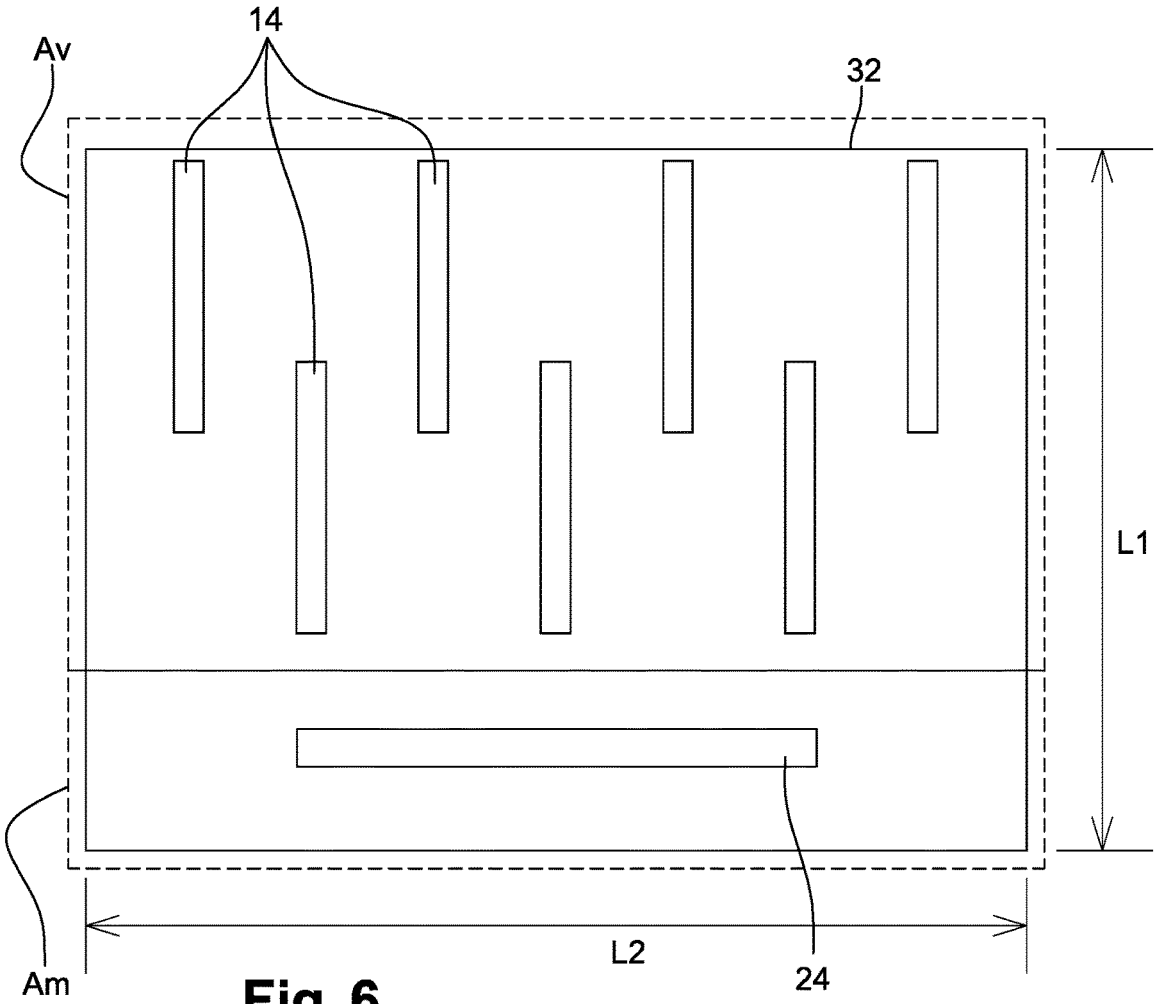
FIG. 6 shows an exemplary arrangement of plates at the base of a slot, according to a third embodiment of the invention.

FIG. 6 shows an example of an arrangement of plates at the base of a slot, according to a third embodiment of the invention. According to the third embodiment of the invention, at least one slot has a base 32 that has:

at least one plate 14 protruding from said base 32 and extending mainly along the axial direction Ax, advantageously on a downstream part Av of said base 32, and at least one plate 24 protruding from said base 32 and extending mainly along the circumferential direction Cir, advantageously on an upstream part Am of said base 32.

The upstream Am and downstream Av parts are defined as a function of the direction of circulation of the cooling air along the axial direction Ax. The at least one plate 24 is advantageously on the upstream part Am of the base 32, in order that the turbulences created within the flux of cooling air by said at least one plate 24 contribute to favouring thermal exchanges at the level of the at least one plate 14 on the downstream part Av. In the example of an arrangement of FIG. 6, the base 32 thus has, on its upstream part Am, a plate 24 extending mainly along the circumferential direction Cir, and on its downstream part Av, seven plates 14 extending mainly along the axial direction Ax.

The base 32 typically has a length L1, measured along the axial direction Ax, comprised between 1 cm and 3 cm, and a width L2, measured along the circumferential direction Cir, comprised between 0.5 cm and 1 cm. According to the third embodiment, the second dimension of each plate 14 is preferentially comprised between 30% and 50% of the length of the base 32 of the slot. The first and second dimensions of each plate 14 preferentially remain chosen according to the indications specified above. The first, second and third dimensions of each plate 24 preferentially remain chosen according to the indications specified above. According to the third embodiment, the plate 24 arranged the most downstream and the plate 14 arranged the most upstream are preferentially spaced apart by 1 to 5 mm along the axial direction Ax.

Figure 7:
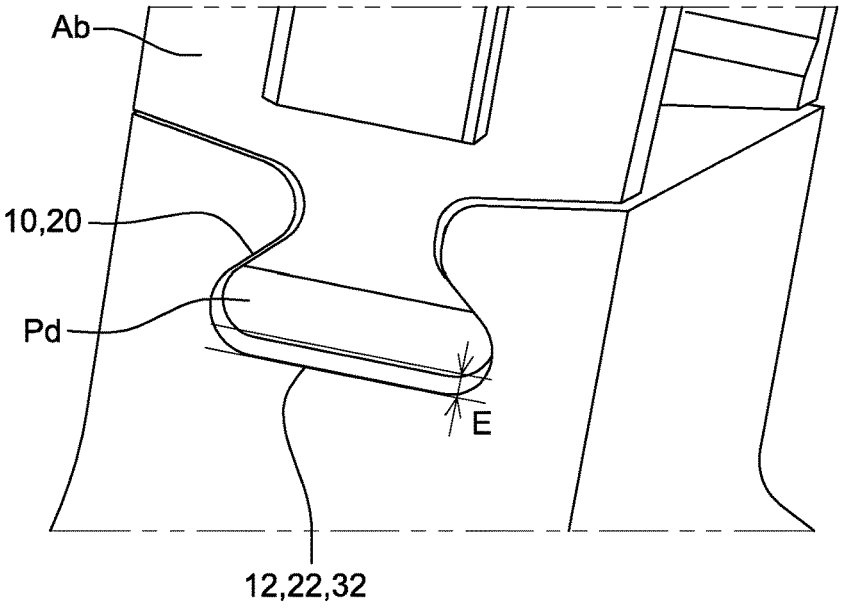
FIG. 7 shows a schematic representation of a blade comprising a root arranged in a slot of a turbo engine rotor disc according to any of the first, second and third embodiments of the invention.

FIG. 7 shows a schematic representation of a blade Ab comprising a root Pd arranged in a slot 10, 20 of a turbo engine rotor disc according to any of the first, second or third embodiments of the invention. FIG. 7 shows that the root Pd of the blade Ab rests on the plurality of plates 14, 24 protruding from the base 12, 22, 32 so as to form a space E between the base 12, 22, 32 of the slot 10, 20 and the root Pd of the blade Ab. The space E, measured along the radial direction Rad, is thus equal, within tolerances, to the first dimension along the radial direction Rad of the plurality of plates 14, 24 according to any of the first, second or third embodiments of the invention.

The plates of each slot according to any of the embodiments are preferentially made of the same material as the rotor disc. The plates of each slot according to any of the embodiments are preferentially directly machined in the bulk of the base of said slot. The embodiment of direct machining in the mass of the base of the slot has in fact the advantage of limiting contact thermal resistances on passing between the plate and the base of the slot, and consequently to further increase cooling. Alternatively, the plates of each slot according to any of the embodiments may be attached at the base of said slot by an additive method such as welding or brazing.

The present invention preferentially relates to a low pressure turbine rotor disc. However, the rotor disc may also be a high pressure turbine rotor disc. Generally speaking, the present invention thus relates to any turbo engine rotor disc. The present invention is naturally not limited to a particular type of fastening for mounting the blade roots on the rotor discs. Generally speaking, the present invention applies to any rotor disc comprising a slot intended to receive a blade root while conserving a space for circulating cooling air.

The invention claimed is:

1. A turbo engine rotor disc comprising, at a periphery thereof, a plurality of slots regularly distributed around a rotation axis and constructed and arranged to each receive a root of a blade of the turbo engine rotor disc, wherein at least one slot of the plurality of slots has a base that has at least three plates regularly distributed over the base and arranged in staggered rows, each plate forming a single part with the base, motionless and united with said base and protruding from said base with a radial measurement at most equal to a measurement along a radial direction of a space between the base of the slot and the root of the blade, each plate of the at least three plates extending along a direction perpendicular to the radial direction such that each plate of the at least three plates has a length in the direction perpendicular to the radial direction that is greater than a length in the radial direction, the at least three plates increasing an exchange surface of the base thereby contributing to improve thermal transfer between a flux of cooling air and said base.

2. The turbo engine rotor disc according to claim 1, wherein at least one plate of the at least three plates protruding from the base has:

a first dimension along the radial direction, a second dimension along an axial direction, and a third dimension along a circumferential direction, the at least one plate extending along the axial direction such that the at least one plate has a length in the axial direction that is longer than a length in the radial direction or the circumferential direction.

3. The turbo engine rotor disc according to claim 2, wherein for the at least one plate, the second dimension along the axial direction is 3 to 60 times greater than the third dimension along the circumferential direction.

4. The turbo engine rotor disc according to claim 1, wherein at least one plate of the at least three plates protruding from the base has:

a first dimension along the radial direction, a second dimension along an axial direction, and a third dimension along a circumferential direction, the at least one plate extending along the circumferential direction such that the at least one plate has a length in the circumferential direction that is longer than a length in the radial direction or the axial direction.

5. The turbo engine rotor disc according to claim 4, wherein for the at least one plate, the third dimension along the circumferential direction is 2 to 16 times greater than the second dimension along the axial direction.

6. The turbo engine rotor disc according to claim 1, wherein at least one slot of the plurality of slots has a base that has:

at least one first plate protruding from said base and extending along an axial direction such that the least one first plate has a length in the axial direction that is longer than a length in any other direction, and at least one second plate protruding from said base and extending along a circumferential direction such that the at least one second plate has a length in the circumferential direction that is longer than a length in any other direction.

7. The turbo engine rotor disc according to claim 6, wherein:

the at least one first plate extending along the axial direction is arranged on a downstream part of the base, and the at least one second plate extending along the circumferential direction is arranged on an upstream part of the base.

8. An assembly comprising a turbo engine rotor disc and at least one blade, the turbo engine rotor disc including, at a periphery thereof, a plurality of slots regularly distributed around a rotation axis of the turbo engine rotor disc and constructed and arranged to each receive a root of a blade, at least one slot of the plurality of slots having a base that has at least three plates regularly distributed over the base and arranged in staggered rows, each plate forming a single part with the base, motionless and united with said base and protruding from said base with a radial measurement at most equal to a measurement along a radial direction of a space between the base of the slot and the root of the blade, each plate of the at least three plates extending along a direction perpendicular to the radial direction such that each plate of the at least three plates has a length in the direction perpendicular to the radial direction that is greater than a length in the radial direction, said at least one blade comprising a root arranged in said at least one slot and resting on the at least three plates so as to form a space between the root of the at least one blade and the base of said at least one slot allowing a cooling air circulation.

* * * * *